US010145250B2

(12) United States Patent
Benson

(10) Patent No.: US 10,145,250 B2
(45) Date of Patent: Dec. 4, 2018

(54) CHOCKING AND RETAINING DEVICE

(71) Applicant: ROLLS-ROYCE plc, London (GB)

(72) Inventor: Christopher Benson, Swindon (GB)

(73) Assignee: ROLLS-ROYCE plc, London (GB)

( * ) Notice: Subject to any disclaimer, the term of this patent is extended or adjusted under 35 U.S.C. 154(b) by 378 days.

(21) Appl. No.: 15/057,407

(22) Filed: Mar. 1, 2016

(65) Prior Publication Data

US 2016/0265370 A1 Sep. 15, 2016

(30) Foreign Application Priority Data

Mar. 12, 2015 (GB) ..... 1504182.5

(51) Int. Cl.

| | |
|---|---|
| ***F01D 5/32*** | (2006.01) |
| ***F01D 5/30*** | (2006.01) |
| ***F01D 25/06*** | (2006.01) |
| *F01D 5/28* | (2006.01) |

(52) U.S. Cl.

CPC ..... *F01D 5/326* (2013.01); *F01D 5/3007* (2013.01); *F01D 5/3053* (2013.01); *F01D 5/323* (2013.01); *F01D 25/06* (2013.01); *F01D 5/282* (2013.01); *F05D 2220/32* (2013.01); *F05D 2220/36* (2013.01); *F05D 2240/30* (2013.01); *F05D 2260/30* (2013.01); *F05D 2260/96* (2013.01); *F05D 2300/432* (2013.01);

(Continued)

(58) Field of Classification Search

CPC ..... F01D 5/3007; F01D 5/3053; F01D 5/323; F01D 25/06; F05D 2260/30

See application file for complete search history.

(56) References Cited

U.S. PATENT DOCUMENTS 4,621,979 A * 11/1986 Zipps ..... F01D 5/141 416/219 R
5,123,813 A * 6/1992 Przytulski ..... F01D 5/26 403/372

(Continued)

FOREIGN PATENT DOCUMENTS

| | | |
|---|---|---|
| EP | 1905957 A1 | 4/2008 |
| WO | 00/31378 A1 | 6/2000 |

OTHER PUBLICATIONS

Aug. 10, 2016 Search Report issued in European Patent Application No. 16157682.

(Continued)

*Primary Examiner* — Ninh H. Nguyen
(74) *Attorney, Agent, or Firm* — Oliff PLC

(57) ABSTRACT

A device for chocking and retaining a dovetail root of a blade of a gas turbine engine in a corresponding axially-extending slot in the rim of a disc includes a retention body having a key portion receivable in a keyway formed in the base of the slot, and a mating portion for mating with a complementary mating portion of the root to prevent relative axial movement between the retention body and the root. The retention body has a lowered position in which the key portion is received sufficiently deeply in the keyway to allow the root to be positioned in the slot without interference from the retention body and also has a raised position in which, after the root is positioned in the slot, a part of the key portion is still received in the keyway while the mating portion mates with the complementary mating portion of the root.

18 Claims, 3 Drawing Sheets

(52) U.S. Cl.
CPC .. *F05D 2300/434* (2013.01); *F05D 2300/603* (2013.01); *F05D 2300/611* (2013.01)

(56) References Cited

U.S. PATENT DOCUMENTS

| | | | | |
|---|---|---|---|---|
| 5,622,476 | A * | 4/1997 | Adde | F01D 5/323 416/220 R |
| 6,447,253 | B2 * | 9/2002 | Tempere | F01D 5/3007 416/221 |
| 7,334,996 | B2 * | 2/2008 | Corbin | F01D 5/3007 416/221 |
| 8,186,961 | B2 * | 5/2012 | Stone | F01D 5/3092 416/221 |
| 8,851,854 | B2 * | 10/2014 | Alexander | F01D 5/3092 416/221 |
| 2011/0052399 | A1 | 3/2011 | Radomski | |
| 2012/0177498 | A1 | 7/2012 | Yarava et al. | |
| 2013/0156591 | A1 | 6/2013 | Alexander | |

OTHER PUBLICATIONS

Aug. 21, 2015 Search Report issued in British Patent Application No. 1504182.5.

* cited by examiner

CHOCKING AND RETAINING DEVICE

FIELD OF THE INVENTION

The present invention relates to a device for chocking and retaining a dovetail root of a blade of a gas turbine engine in a corresponding dovetail slot in the rim of a disc.

BACKGROUND OF THE INVENTION

Many aero-engines adopt a dovetail style of fan blade root which locates in a corresponding slot formed in the rim of the fan disc. During service operation, the fan assembly is subject to a complex loading system, consisting of centripetal load, gas-bending and vibration. The dovetail geometry copes particularly well with this kind of loading conditions.

On assembly, the blades are "chocked" up to mate the flanks of the corresponding dovetail slots (in the absence of any centrifugal force when static) by inserting a slider beneath the blade root. When the rotor assembly is spinning, the blades are restrained radially by the dovetail slots, which are sized according to mechanical rules based on extreme load cases.

To prevent the blades moving axially forward or rearward a number of approaches can be employed. One is to use a solid block or plate of metal inserted into machined grooves in the disc either at the front and back of the dovetail slot or mid slot (which requires a corresponding groove machined into the blade root). This approach relies on the shear strength of the plates (and disc grooves) to withstand any axial force placed on them. The plates are sized on the worst case of either large bird impact or trailing blade impact following a fan blade off event.

The large forces seen during these extreme cases lead to a thick plate design and a correspondingly large extension of the disc. This requires larger and more expensive disc forging and increases the disc machining time. In addition, the extension: adds weight and therefore increases specific fuel consumption; can use up engine space and encroach on adjacent components; and can lead to pumping and windage, creating a secondary airflow and associated temperature increase. Further, the shear plate produces a larger part count, which increases costs and assembly time.

The mid slot approach requires machining of the blade root to accommodate the plate, which breaks through the dovetail flanks. This can be acceptable in the case of a metal blade, but may cause issues in a composite blade, where the groove in the blade root is typically perpendicular to the fibre plies in the root and has sharp edges, which may cause stress concentrations. Breaking the flanks can also require the blade root to be extended axially to meet acceptable crushing stress limits (which again lead to a corresponding increase in disc axial length).

Current blade retention approaches also offer little vibrational damping to the blade or disc.

SUMMARY OF THE INVENTION

In a first aspect, the present invention provides a device for chocking and retaining a dovetail root of a blade of a gas turbine engine in a corresponding axially-extending slot in the rim of a disc, the device including:

a retention body having a key portion receivable in a keyway formed in the base of the slot, and a mating portion for mating with a complementary mating portion of the root to prevent relative axial movement between the retention body and the root, the retention body having a lowered position in which the key portion is received sufficiently deeply in the keyway to allow the root to be positioned in the slot without interference from the retention body, and a raised position in which, after the root is positioned in the slot, a part of the key portion is still received in the keyway while the mating portion mates with the complementary mating portion of the root;

a slider which is axially insertable in the slot;

wherein the slider and the retention body are configured so that, on axial insertion of the slider in the slot after the root is positioned in the slot, the slider moves the retention body from its lowered position to its raised position, whereby the retention body urges the blade radially outwardly thereby mating flanks of the root to flanks of the slot, while the part of the key portion still received in the keyway retains the root axially in the slot.

Advantageously, the retention body can be retained within the forging envelope of the disc, and does not require any extension of the disc, saving on forging and machining costs and weight. Further, the retention body is compatible with composite blades, not requiring any break in the flanks of the blade root. The cross sectional profile of the retention body can be configured for shear strength, compressive/bucking strength, weight and vibrational response. Under extreme axial loading, impact energy can be dissipated through shear and compressive forces between the retention body, blade root and disc, rather than pure shear as with a conventional retaining plate.

In a second aspect, the present invention provides a rotor assembly of a gas turbine engine, the assembly having:

a disc;

a circumferential row of blades (e.g. composite blades), each blade having a dovetail root which is retained in a corresponding axially-extending slot in the rim of the disc; and a plurality of devices according to the first aspect for chocking and retaining the dovetail roots of the blades in the slots;

wherein each slot has a keyway formed in the base thereof, the key portion of the retention body of each device is received in a respective one of the keyways, and the slider of each device is inserted in a respective one of the slots to move its retention body to the raised position.

For example, the assembly can be a fan assembly, with the blades being fan blades, and the disc being a fan disc.

In a third aspect, the present invention provides a gas turbine engine having the rotor assembly of the second aspect.

Optional features of the invention will now be set out. These are applicable singly or in any combination with any aspect of the invention.

The key portion may comprise one or more legs and the keyway comprises one or more slots for respectively receiving the legs. For example, the key portion may have two legs, and the keyway two slots. The slider can then insert between the two legs to move the retention body from its lowered position to its raised position.

The retention body may have a chamfered lead-in portion against which the slider slides on axial insertion of the slider in the slot to move the retention body from its lowered position to its raised position. The chamfered lead-in portion can facilitate the action of the slider on the retention body.

The slider may have a chamfered or rounded leading edge. This can also facilitate the action of the slider on the retention body.

The mating portion may form an arc-shaped surface of the retention body and the complementary mating portion may form a correspondingly arc-shaped surface of the root, the normal to the plane of the arc of each arc-shaped surface being substantially perpendicular to the engine axis, whereby the arc-shaped surfaces mate to prevent relative axial movement between the retention body and the root. Such shapes allow the complementary mating portion to be a shallow feature of the root which does not break the flanks or ends of the root. It is thus suitable for retaining and chocking a composite blade. Under extreme axial loading, impact energy is dissipated through shear resistance at the part of the key portion which is still received in the keyway. However, such shapes also allow some energy to be redistributed as compressive force into the dovetail root. The normal to the plane of each arc may be substantially perpendicular to the radial direction. The arc-shaped surface of the retention body can be a convex or a concave surface.

The mating portion of the retention body may have a relatively compliant outer layer for enhanced contact of the retention body with the root. Thus, for example, the outer layer can be formed of an elastomer. In contrast, the key portion of the retention body can be relatively rigid (being formed e.g. of metal or composite material). The compliant layer can provide damping, impact protection, and take up any tolerance between the root, rotor and retention body.

The slider may have a low friction coating (formed e.g. of PTFE or polyimide) at the innermost and/or outermost surface thereof to facilitate its insertion.

The slider may have one or more chock springs which are arranged to act, in use, on the root to also urge the blade radially outwardly. For example, the chock spring(s) can be located to act on the root to both sides of the complementary mating portion.

The device may include a plurality of the retention bodies, each movable by the slider from its lowered position to its raised position. The slot may similarly have a plurality of respective keyways. For example, the keyways, and hence the retention bodies, can be axially spaced along the slot.

The slider may have a stop at an end thereof which, in use, abuts a face of the disc or the root when the slider is fully inserted in the slot to prevent over-insertion of the slider. For example, the stop can be a flange which abuts an external face of the disc and/or the root. Another option is for the stop to abut a surface, such as a flat, provided by the disc and/or the root within the slot.

Generally, the dovetail root and slot are straight, but a curved root and slot are not precluded.

BRIEF DESCRIPTION OF THE DRAWINGS

Embodiments of the invention will now be described by way of example with reference to the accompanying drawings in which.

DETAILED DESCRIPTION AND FURTHER OPTIONAL FEATURES OF THE INVENTION

Figure 1:
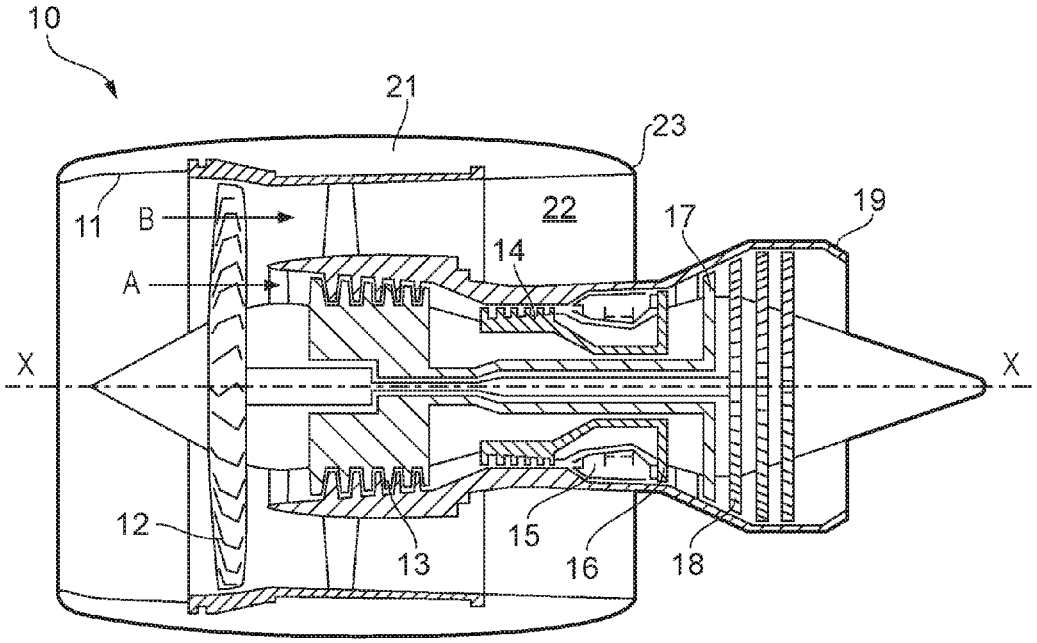
FIG. 1 shows a longitudinal cross-section through a ducted fan gas turbine engine.
Figure 2A:
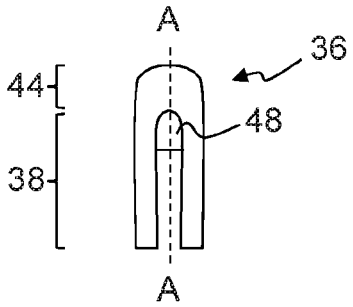
FIGS. 2(*a*)-2(*e*) shows schematically FIG. 2(*a*) an end-on view of a retention body of a device for chocking and retaining a dovetail root of a blade of a gas turbine engine in a corresponding axially-extending slot in the rim of a disc, FIG. 2(*b*) a longitudinal cross-section through the retention body along plane A-A, FIG. 2(*c*) a plan view of a keyway formed in the base of the slot, FIG. 2(*d*) a longitudinal cross-sectional view of the retention body, root and disc with the retention body in a lowered position, FIG. 2(*e*) a longitudinal cross-sectional view of the retention body, root and disc with the retention body moved to a raised position by a slider, and FIG. 2(*f*) a transverse section through the retention body, slider, root and disc with the retention body in the raised position.
Figure 2B:
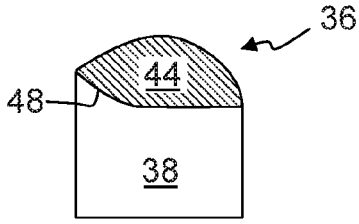
Figure 2C:
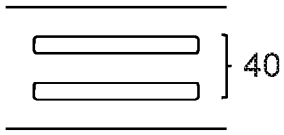
Figure 2D:
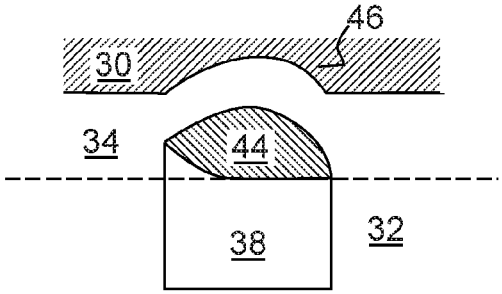
Figure 2E:
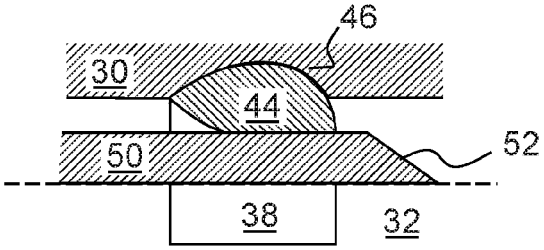
Figure 2F:
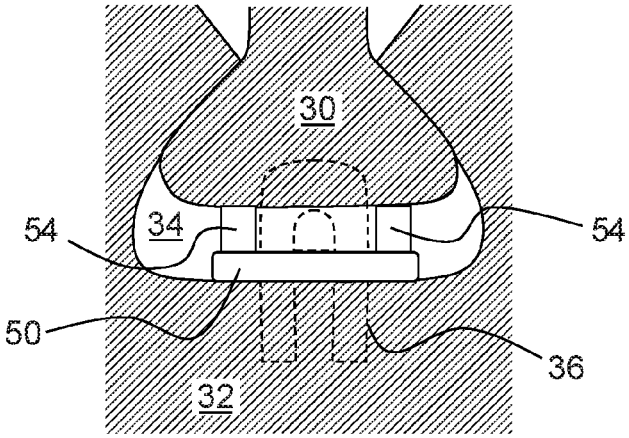

With reference to FIG. 1, a ducted fan gas turbine engine incorporating the invention is generally indicated at 10 and has a principal and rotational axis X-X. The engine comprises, in axial flow series, an air intake 11, a propulsive fan 12, an intermediate pressure compressor 13, a high-pressure compressor 14, combustion equipment 15, a high-pressure turbine 16, an intermediate pressure turbine 17, a low-pressure turbine 18 and a core engine exhaust nozzle 19. A nacelle 21 generally surrounds the engine 10 and defines the intake 11, a bypass duct 22 and a bypass exhaust nozzle 23.

During operation, air entering the intake 11 is accelerated by the fan 12 to produce two air flows: a first air flow A into the intermediate-pressure compressor 13 and a second air flow B which passes through the bypass duct 22 to provide propulsive thrust. The intermediate-pressure compressor 13 compresses the air flow A directed into it before delivering that air to the high-pressure compressor 14 where further compression takes place.

The compressed air exhausted from the high-pressure compressor 14 is directed into the combustion equipment 15 where it is mixed with fuel and the mixture combusted. The resultant hot combustion products then expand through, and thereby drive the high, intermediate and low-pressure turbines 16, 17, 18 before being exhausted through the nozzle 19 to provide additional propulsive thrust. The high, intermediate and low-pressure turbines respectively drive the high and intermediate-pressure compressors 14, 13 and the fan 12 by suitable interconnecting shafts.

The fan 12 comprises a fan disc and a circumferential row of fan blades extending from the disc. Each blade has as a dovetail root 30 which is retained in a corresponding axially-extending slot 34 in the rim of the disc 32. To chock the flanks of roots radially outwardly against the flanks of the slots, and to retain the roots axially within the slots, each blade has a chocking and retaining device according to the present invention.

FIG. 2 shows schematically (a) an end-on view of a retention body 36 of the device, and (b) a longitudinal cross-section through the retention body along plane A-A. The retention body has a key portion 38 in the form of two spaced legs. These legs, in use, are received in spaced slots forming a keyway 40 shown schematically in FIG. 2(*c*), which is a plan view of part of the base of the slot 34 of the disc 32. The retention body 36 also has a mating portion 44 which forms an arc-shaped surface of the body.

FIG. 2(*d*) shows schematically a longitudinal cross-sectional view of the retention body 36, root 30 and disc 32 with the key portion 38 fully inserted in the keyway 40 such that the retention body is in a lowered position. This allows the root to be slid along the axially-extending slot 34 without interference from the retention body. The root has a complementary mating portion 46 with a correspondingly arc-shaped surface. The two mating portions are directly opposite each other when the root is fully inserted in the slot 34.

The retention body 36 also has a chamfered lead-in portion 48 located between the two legs of the key portion 38. With the root 30 fully inserted in the slot 34, a slider 50 of the device is also inserted into the slot 34. The slider has a chamfered leading edge 52 which engages with the chamfered lead-in portion 48. Further insertion of the slider then pushes the retention body into a raised position, which is shown schematically in the longitudinal cross-sectional view of the retention body, root and disc of FIG. 2(*e*). The slider may have a low friction coating (formed e.g. of PTFE or polyimide) at the innermost and/or outermost surface thereof to facilitate its insertion.

In the raised position, the retention body 36 urges the blade radially outwardly thereby mating flanks of the root 30 to flanks of the slot 34. Moreover, the two mating portions 44, 46 mate with each other, their arc-shaped surfaces preventing relative axial movement between the retention body and the root. In this way, axial loads on the blade can be transmitted via its root to the retention body, and then transferred via shear at the key portion 38 and keyway 40 to the disc 32.

Advantageously, the arc-shaped surfaces can reduce stress concentration in the root 30 by their gradual curvatures. Generally, the normal to the plane of the arc of each arc-shaped surface is substantially perpendicular to the engine axis (and conveniently also substantially perpendicular to the radial direction). This helps the mating portions 44, 46 to prevent relative axial movement between the retention body 36 and the root. The arc-shaped surfaces are also preferably shallow and in the complementary mating portion 46 do not break the root ends or flanks. Under extreme axial loading of the blade, the arc-shaped surfaces can help to redistribute some of the axial load as a compressive force driving the root 30 radially up in the slot 34.

FIG. 2(*f*) shows schematically a transverse section through the retention body 36, slider 50 root 30 and disc 32 with the retention body in the raised position. The slider can have plural prongs. The central prong provides the chamfered leading edge 52 and raises the retention body. Outer prongs can carry one or more chock springs 54 (e.g. metallic springs or rubber blocks) which also urge the blade radially outwardly. Such springs can provide a useful damping function. Indeed, the mating portion 44 of the retention body may have a relatively compliant outer layer for enhanced contact of the retention body with the root. For example, the outer layer can be formed of an elastomer to improve damping, impact protection, and take up any tolerance between the root, rotor and retention body.

Figure 3A:
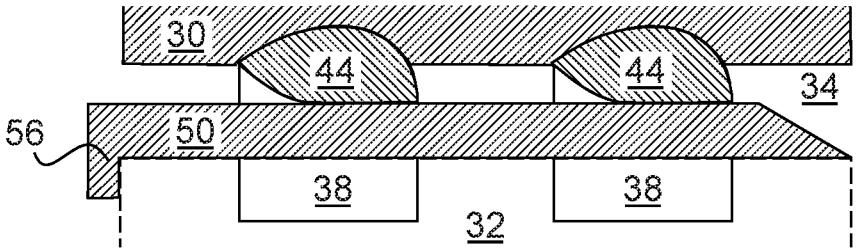
FIGS. 3(*a*)-3(*b*) shows schematically FIG. 3(*a*) a longitudinal cross-sectional view of two retention bodies, a root and a disc with the retention bodies in raised positions, and FIG. 3(*b*) a longitudinal cross-sectional view of a single retention body, a root and a disc with the retention body in the raised position.
Figure 3B:
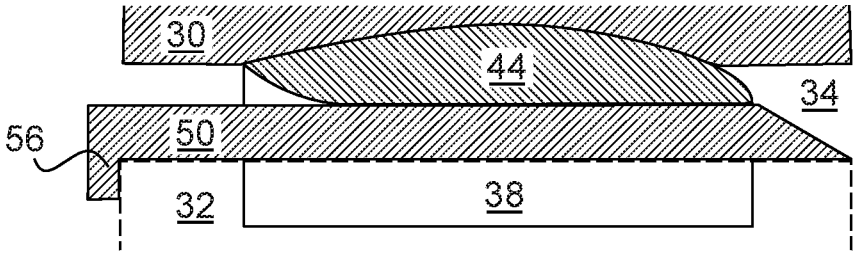

As shown schematically in FIG. 3(*a*), the device may include a plurality of the retention bodies 36, each movable by the slider 50 from its lowered position to its raised position. The slot 34 may then similarly have a plurality of respective keyways 40. For example, the keyways, and hence the retention bodies, can be axially spaced along the slot. Another option, shown schematically in FIG. 3(*b*), is for the device to have a single retention body which extends almost the full length of the slot 34. Such a retention body could have a single key portion 38, as illustrated, or a plurality of axially spaced key portions located in respective keyways.

As shown in FIGS. 3(*a*) and (*b*), the slider 50 can have a stop 56 which abuts against the external face of the disc 32 to prevent further insertion of the slider.

Figure 4:
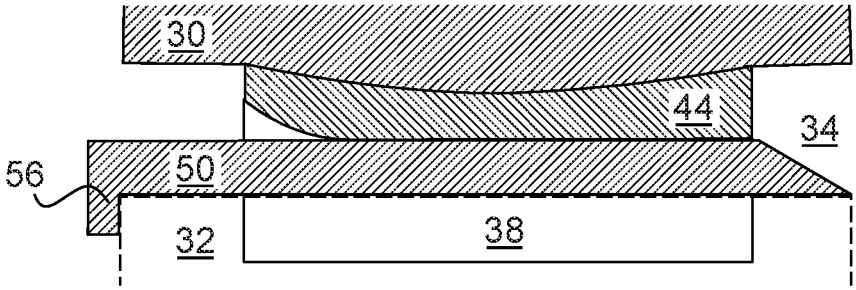
FIG. 4 shows schematically a longitudinal cross-sectional view of a variant single retention body, a root and a disc with the retention body in the raised position.

As shown in FIG. 4, the mating portion 44 can have a concave arc-shaped surface, rather than a convex arc-shaped surface.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the scope of the invention.

The invention claimed is:

1. A device for chocking and retaining a dovetail root of a blade of a gas turbine engine in a corresponding axially-extending slot in the rim of a disc, the device including:

a retention body having:

a key portion receivable in a keyway formed in the base of the slot, the key portion comprising one or more legs and the keyway comprising one or more slots for respectively receiving the legs, a mating portion for mating with a complementary mating portion of the root to prevent relative axial movement between the retention body and the root, and the retention body having a lowered position in which the key portion is received sufficiently deeply in the keyway to allow the root to be positioned in the slot without interference from the retention body, and a raised position in which, after the root is positioned in the slot, a part of the key portion is still received in the keyway while the mating portion mates with the complementary mating portion of the root;

a slider which is axially insertable in the slot;

wherein the slider and the retention body are configured so that, on axial insertion of the slider in the slot after the root is positioned in the slot, the slider moves the retention body from its lowered position to its raised position, whereby the retention body urges the blade radially outwardly thereby mating flanks of the root to flanks of the slot, while the part of the key portion still received in the keyway retains the root axially in the slot.

2. A device according to claim 1, wherein the retention body has a chamfered lead-in portion against which the slider slides on axial insertion of the slider in the slot to move the retention body from its lowered position to its raised position.

3. A device according to claim 1, wherein the slider has a chamfered or rounded leading edge.

4. A device according to claim 1, wherein the mating portion forms an arc-shaped surface of the retention body and the complementary mating portion forms a correspondingly arc-shaped surface of the root, the normal to the plane of the arc of each arc-shaped surface being substantially perpendicular to the engine axis, whereby the arc-shaped surfaces mate to prevent relative axial movement between the retention body and the root.

5. A device according to claim 4, wherein the normal to the plane of each arc is substantially perpendicular to the radial direction.

6. A device according to claim 4, wherein the arc-shaped surface of the retention body is a convex surface.

7. A device according to claim 4, wherein the arc-shaped surface of the retention body is a concave surface.

8. A device according to claim 1, wherein of the mating portion of the retention body has a relatively compliant outer layer for enhanced contact of the retention body with the root.

9. A device according to claim 1, wherein the slider has one or more chock springs which are arranged to act, in use, on the root to also urge the blade radially outwardly.

10. A device according to claim 1, wherein the slider has a stop at an end thereof which, in use, abuts a face of the disc or the root when the slider is fully inserted in the slot to prevent over-insertion of the slider.

11. A device according to claim 1 including a plurality of the retention bodies, each movable by the slider from its lowered position to its raised position.

12. A rotor assembly of a gas turbine engine, the assembly having:

a disc;

a circumferential row of blades, each blade having a dovetail root which is retained in a corresponding axially-extending slot in the rim of the disc; and a plurality of devices according to claim 1 for chocking and retaining the dovetail roots of the blades in the slots;

wherein each slot has a keyway formed in the base thereof, the key portion of the retention body of each device is received in a respective one of the keyways, and the slider of each device is inserted in a respective one of the slots to move its retention body to the raised position.

13. A gas turbine engine having the rotor assembly of claim 12.

14. A device for chocking and retaining a dovetail root of a blade of a gas turbine engine in a corresponding axially-extending slot in the rim of a disc, the device including:

a retention body having:

a key portion receivable in a keyway formed in the base of the slot, a mating portion for mating with a complementary mating portion of the root to prevent relative axial movement between the retention body and the root, the mating portion forming an arc-shaped surface of the retention body and the complementary mating portion forming a correspondingly arc-shaped surface of the root, the normal to the plane of the arc of each arc-shaped surface being substantially perpendicular to the engine axis, whereby the arc-shaped surfaces mate to prevent relative axial movement between the retention body and the root, and the retention body having a lowered position in which the key portion is received sufficiently deeply in the keyway to allow the root to be positioned in the slot without interference from the retention body, and a raised position in which, after the root is positioned in the slot, a part of the key portion is still received in the keyway while the mating portion mates with the complementary mating portion of the root;

a slider which is axially insertable in the slot;

wherein the slider and the retention body are configured so that, on axial insertion of the slider in the slot after the root is positioned in the slot, the slider moves the retention body from its lowered position to its raised position, whereby the retention body urges the blade radially outwardly thereby mating flanks of the root to flanks of the slot, while the part of the key portion still received in the keyway retains the root axially in the slot.

15. A device according to claim 14, wherein the normal to the plane of each arc is substantially perpendicular to the radial direction.

16. A device according to claim 14, wherein the arc-shaped surface of the retention body is a convex surface.

17. A device according to claim 14, wherein the arc-shaped surface of the retention body is a concave surface.

18. A device for chocking and retaining a dovetail root of a blade of a gas turbine engine in a corresponding axially-extending slot in the rim of a disc, the device including:

a retention body having:

a key portion receivable in a keyway formed in the base of the slot, a mating portion for mating with a complementary mating portion of the root to prevent relative axial movement between the retention body and the root, and the retention body having a lowered position in which the key portion is received sufficiently deeply in the keyway to allow the root to be positioned in the slot without interference from the retention body, and a raised position in which, after the root is positioned in the slot, a part of the key portion is still received in the keyway while the mating portion mates with the complementary mating portion of the root;

a slider which is axially insertable in the slot, the slider having one or more chock springs which are arranged to act, in use, on the root to also urge the blade radially outwardly;

wherein the slider and the retention body are configured so that, on axial insertion of the slider in the slot after the root is positioned in the slot, the slider moves the retention body from its lowered position to its raised position, whereby the retention body urges the blade radially outwardly thereby mating flanks of the root to flanks of the slot, while the part of the key portion still received in the keyway retains the root axially in the slot.

* * * * *